United States Patent [19]

Kasai

[11] 4,271,689

[45] Jun. 9, 1981

[54] SLIDER WITH A BUILT-IN LOCKING DEVICE IN A SLIDE FASTENER

[75] Inventor: Kazumi Kasai, Namerikawa, Japan

[73] Assignee: Yoshida Kogyo K.K., Tokyo, Japan

[21] Appl. No.: 17,977

[22] Filed: Mar. 6, 1979

[30] Foreign Application Priority Data

Mar. 7, 1978 [JP] Japan ..... 53/28757[U]

[51] Int. Cl.[3] ..... E05B 67/38

[52] U.S. Cl. ..... 70/68; 24/205.15 H

[58] Field of Search ..... 70/68; 24/205.15 H, 24/205.14 K, 205.14 A

[56] References Cited

U.S. PATENT DOCUMENTS

| | | | |
|---|---|---|---|
| 2,741,114 | 4/1956 | Poux | 70/68 |
| 3,089,328 | 5/1963 | Clauss | 70/68 |

FOREIGN PATENT DOCUMENTS

| | | | |
|---|---|---|---|
| 513749 | 9/1929 | Fed. Rep. of Germany | 24/205.15 H |
| 635387 | 4/1950 | United Kingdom | 70/68 |

*Primary Examiner*—Robert L. Wolfe

*Attorney, Agent, or Firm*—Hill, Van Santen, Steadman, Chiara & Simpson

[57] ABSTRACT

The slider for a slide fastener of the invention has a locking device as built in the front half portion thereof with a key hole open upward, and a support member for a pull tab is composed of upright leg portions standing at or near the rear and the front ends of the slider body, one of the leg portions positioned at or near the front end being provided with a key guide leading to the keyhole of the locking device and an arm spanned between the leg portions. With this construction of the locking device and the support member for the pull tab, advantages are obtained that the slider body is raised always at the leading end of it by pulling the tab obliquely so that the sliding movement of the slider receives no resistance by the depression of the leading end onto chain element rows and that the placement of a key in the key hole is not hampered regardless of the position of the pull tab.

2 Claims, 8 Drawing Figures

SLIDER WITH A BUILT-IN LOCKING DEVICE IN A SLIDE FASTENER

BACKGROUND OF THE INVENTION

The present invention relates to an improved slider for a slide fastener with a locking device built therein to lock the slide fastener in the closed state and prevent the slider from invertently releasing.

Many prior art sliders of slide fasteners have a locking device within the element guide of a slider body with a key hole open in the upper surface of the slider body and a support member for a pull tab is provided on the upper surface of the body. It is usual that the support for the pull tab is provided only in the rear half portion of the slider body in order not to be an obstacle against providing the key hole in the front half portion of the slider body. For example, the support for the pull tab is in a form of a shackle extending over the slider body with two leg portions, one being positioned at the rearmost end of the body and the other being positioned at about the middle portion of the body and at least one of the leg portions being integrally fixed on to the upper surface of the slider body and the pull tab is linked with a shackle at the ring-wise end portion thereof (see, for example, Japanese Utility Model Publication No. 41-9315). Therefore, pulling of the slider in the rearward direction by the pull tab put down rearwardly can be performed without difficulty whereby the slider is brought into smooth sliding movement whereas, on the other hand, some difficulties are encountered in pulling the slider in the forward direction by the pull tab put down forwardly, i.e. on the locking device in the front half portion of the slider body, because the slider body becomes inclined with its rear end somewhat raised and with its front end somewhat lowered resulting in depression of the lower front corner thereof on to the element rows to give a strong resistance to the sliding movement of the slider along the element rows as a consequence of the location of the pulling point at about the center portion of the slider body and the vertical component of the pulling force given to the pull tab which is engaged with the shackle-like support member at the upper front corner thereof just above about the center portion of the slider body.

SUMMARY OF THE INVENTION

It is therefore an object of the present invention to present a novel and improved slider of a slide fastener with a locking device which can be slided without difficulty both in the rearward and forward directions to close or open the slide fastener by providing the support member of the pull tab in a form something like a shackle extending substantially over the whole length of the slider body so that the pulling point of the slider is located always at the leading end toward the direction of movement without giving any obstacle to the provision of a key hole in the upper surface of the slider body and the placement of the key in the key hole.

The slider with a locking device in a slide fastener according to the present invention comprises (a) a slider body with the locking device built within the element guide thereof and provided with a key hole open in the front half of the upper surface thereof, (b) a support member for a pull tab in a form of a shackle extending substantially over whole length of the slider body as composed of two upright leg portions positioned at or near the front ends of the upper surface of the slider body and an arm spanned between the two upright leg portions, at least one of the upright leg portions being integrally fixed to the slider body and one of the upright leg portions positioned in the front portion of the slider body being provided with a key guide leading to the key hole, and (c) a pull tab in engagement with the support member at the ring-wise end portion thereof.

DETAILED DESCRIPTION OF THE PREFERRED EMBODIMENTS

Figure 1:
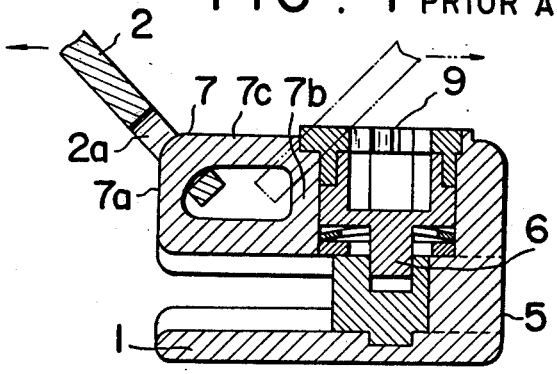
FIG. 1 PRIOR ART
FIG. 1 is a schematic longitudinal cross section of a conventional slider with a locking device for a slide fastener.

FIG. 1 is a schematic longitudinal cross section of a prior art slider for a slide fastener with a locking device, in which a locking device 6 is built within an element guide 5 of a slider body 1 with a key hole 9 which is open in the front half of the upper surface of the slider body 1. On the upper surface of the slider body 1 is fixedly provided a support member 7 for a pull tab 2, the support member being composed of two upright leg portions *7a*, *7b* and an arm *7c* spanned between the two upright leg portions *7a*, *7b* to make a form of a shackle. One of the leg portions *7a* is positioned on the rear end of the slider body 1 and the other one of the upright leg portions *7b* is positioned at about the center portion of the slider body 1 in a manner such that the support member 7 extends covering about a half length of the slider body 1. Pull tab 2 is engaged with the support member 7 at its ring-wise end portion *2a*, which is picked up with finger tips when the slide fastener is to be opened or closed by sliding the slider rearwardly or forwardly, i.e. to the left or to the right according to FIG. 1.

When the slider is to be moved rearwardly, or to the left, the pulling point, i.e. a position at which the support member 7 is contacted with the ring-wise end portion *2a* of the pull tab 2, is at the upper rear corner of the shackle so that the rear end of the slider body 1 is slightly raised to exert no resistance against the sliding movement of the slider body along the element rows. On the other hand, when the slider is to be moved in the forward direction, or to the right, a similar pulling point is at the upper front corner of the shackle and the slider body 1 is raised at the center portion thereof with the lower front corner of the slider body 1 being depressed on to the element rows so that the sliding movement of the slider along the element rows receives a strong resistance.

Furthermore, the key hole 9 open in the front half of the slider body 1 is often covered by the pull tab 2 when the pull tab 2 is put down forwardly on the front half of the slider body 1 to be an obstacle against insertion of a key into the key hole 9.

Figure 2:
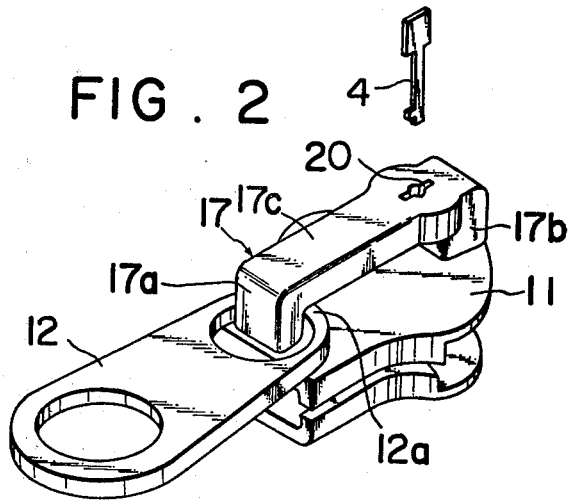
FIG. 2 is a perspective view of the inventive slider with a locking device and a key held thereabove.
Figure 3:
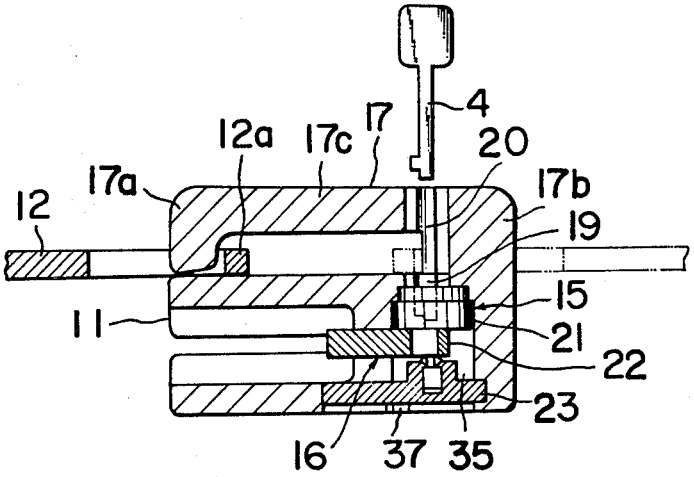
FIG. 3 is a longitudinal cross section of the slider shown in FIG. 2 and a key held thereabove.

In FIG. 2 and FIG. 3 showing a perspective view and a longitudinal cross section, respectively, of an embodiment of the slider of the present invention with a locking device 16 as built in an element guide 15, a support member 17 for a pull tab 12 extends substantially over whole length of a slider body 11 with upright leg portions 17*a*, 17*b* of the support member 17 being positioned at or near the rear and the front ends of the slider body 11 and with an arm 17*c* spanned between both upright leg portions 17*a*, 17*b*. In the embodiment shown in FIG. 2 or 3, only the front side one 17*b* of the upright leg portions 17*a*, 17*b* is integrally fixed to the slider body 11 with the leg portion 17*a* isolated from the slider body 11 but it is optional to have both of the upright leg portions 17*a*, 17*b* integrally fixed to the slider body 11.

Pull tab 12 is engaged with the support member 17 at the ring-wise end portion 12*a* thereof so that the pull tab 12 can be freely put down either rearwardly or forwardly according to need for the sliding movement of the slider to open or to close the slide fastener. The locking device built within the element guide 15 of the slider body 11 has a key hole 19 open in the front half of the upper surface of the slider body 11. In a position corresponding to the above key hole 19 and leading thereto, a key guide 20 is provided in the upright leg portion 17*b* penetrating therethrough or engraved on the surface thereof facing the other upright leg portion 17*a*, through which a key 4 is readily inserted into a key hole 19 and turned to lock the locking device 16 when the slider is to be locked at a position where the slider is secured to prevent inadvertent sliding to open the slide fastener or when the slider is to be unlocked.

Figure 4:
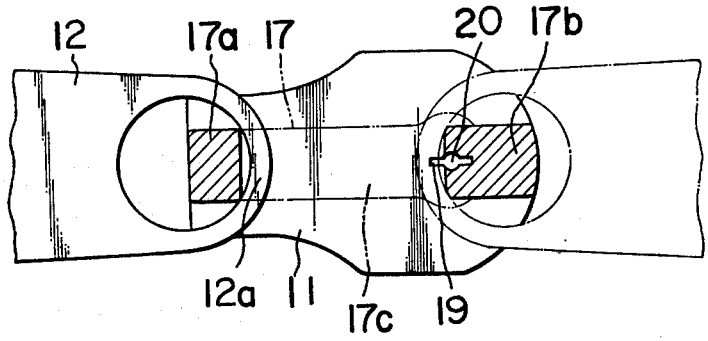
FIG. 4 is a plan view illustrating the positions of the pull tab relative to the slider body and the supporting member.

With the above construction of the support member 17 and the key guide 20 leading to the locking device 16, the pulling point of pull tab 12 when the slider is to be slided rearwardly to open the slide fastener is at the upper rear corner of the support member 17 above about the rear end of the slider body 11 as is shown in FIG. 3 or 4, whilst a similar pulling position when the slider is to be moved forwardly is at the upper front corner of the support member 17 above about the front end of the slider body 11, as also shown in FIG. 3 or 4. As a consequence, the front end of the slider body 11 is slightly raised when the pull tab 12 is pulled obliquely in the forward direction so that the sliding of the slider body 11 along the element rows receives no resistance by the contacting of the lower front corner of the slider body 11 with the elements to ensure smoothness of the sliding of the slider body 11.

Figure 6:
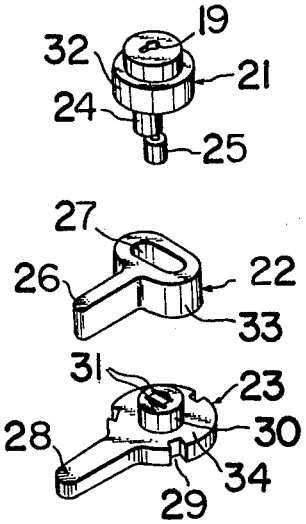
FIG. 6 is a perspective view of the locking device in FIGS. 3 and 4 as disassembled.

The structure of the locking device 16 per se embedded in the element guide 15 is rather conventional. FIG. 6 depicts an example of the locking device 16 as disassembled into three parts, i.e. a crank 21, a sliding body 22 and a cap 23. The crank 21 has the key hole 19 open in the upper surface of a disc 32 thereof and is provided with a crank pin 24 connected to the lower surface of the disc 32 at an eccentric position so as to revolve eccentrically around the axis of the disc 32 when the disc 32 is rotated by turning the key inserted into the key hole 19. The rotation of the disc 32 is ensured by fitting a supporting pivot 25 connected to the lower end of the crank pin 24 coaxially with the disc 32 to the bearing 30 on the cap 23. The sliding body 22 is in a T-shaped form composed of a key pin 26 protruded from an elliptical body 33 in the direction perpendicular to the longer axis of the elliptical body 33. The sliding body 22 is provided with an oblong opening 27 having its axis in parallel with the longer axis of the elliptical body 33, which is penetrated by the crank pin 24 of the crank 21. The cap 23 is in a form of a disc 34 with a tongue 28 protruded therefrom and provided with a bearing 30 on the center of a disc 34 to receive the lower end of the supporting pivot 25 of the crank 21. The bearing 30 has springs 31 to hold the supporting pivot 25. The locking device 16 composed of the above three parts 21, 22 and 23 is inserted into a hollow space 35 in the element guide 15 from below the slider body 11 and fixed by caulking engagement of each groove 29 of the disc 34 of the cap 23 with each hook 37 (indicated in FIG. 3) which is upwardly protruded from the lower piece of the slider body 11.

Figure 5:
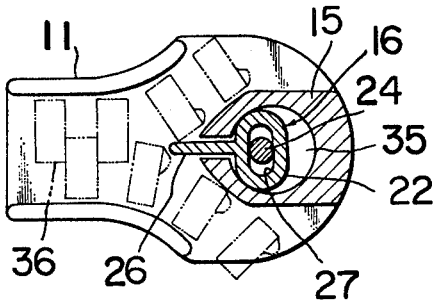
FIG. 5 is a cross sectional view of the locking device as embedded in the element guide when the slider is in a locked state.

As is shown in FIG. 5 illustrating a horizontal cross section of the locking device 16 in relation to the slider body 11 and separable element rows 36, the key pin 26 is put between the two separable rows 36 so that the elements in both rows are jammed at the tip of the key pin 26 locking the forward sliding movement of the slider to keep the slide fastener as closed. When the slider is to be unlocked, the crank 21 is rotated by 180° with the key 4 inserted into the key hole 19 through the key guide 20 whereby the crank pin 24 revolves around the axis of the disc 32 of the crank 21 eccentrically so as to push the sliding body 22 forwardly (to the right in FIG. 5) until the key pin 26 is retracted into the element guide 15 releasing the elements of both element rows 36 from jamming at the tip of the key pin 26, whereby the slider regains its free sliding to open or close the slide fastener. Even when the pull tab 12 is put down forwardly as is shown in FIG. 4 by the single chain lines, the insertion of the key 4 into the key hole 19 is not disturbed by the end of the pull tab 12 since the key hole 19 is led to the key guide 20 open at the head of the upright leg portion 17*b* of the support member 17.

Figure 7:
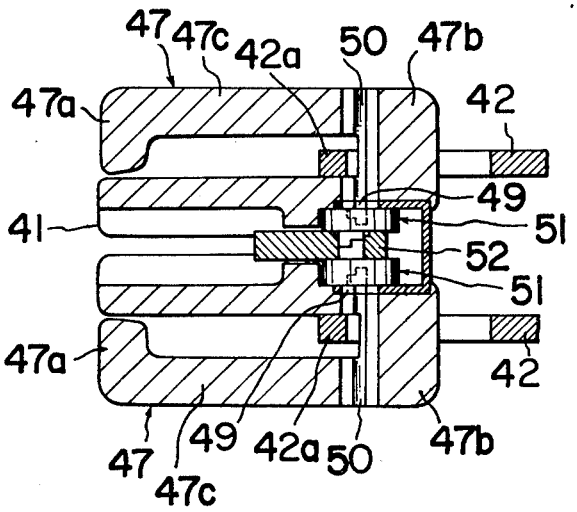
FIG. 7 is a longitudinal cross section of another embodiment of the inventive slider having two pull tabs on both sides thereof.
Figure 8:
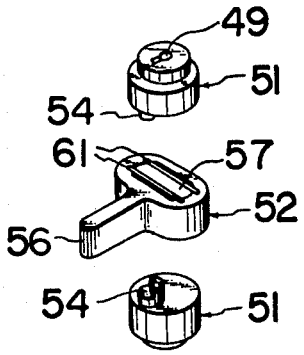
FIG. 8 is a perspective view of a locking device as disassembled, which is suitable to be embedded in the slider shown in FIG. 7.

FIG. 7 shows another embodiment of the present invention in which the slider has two pull tabs 42, 42 symmetrically on both sides thereof as engaged at the ring-wise end portions 42*a*, 42*a* with respective support members 47, 47, each of which extends over substantially whole length of the slider body 41 as composed of two upright leg portions 47*a*, 47*b* and arms 47*c*, 47*c*. The support members 47, 47 are integrally fixed at the upright leg portions 47*b*, 47*b* alone to the slider body 41 while the upright leg portions 47*a*, 47*a* are isolated from the slider body 41. The upright leg portions 47*b*, 47*b* are each provided with a key guide 50 leading to a key hole 49. With the above construction of the slider with two pull tabs 42, 42, the same advantages as in the slider with a single pull tab 12 shown in FIGS. 2 and 3 can be obtained when the slider is slided regardless of the selection of the pull tab 42 by which the slider is pulled to be slided, although the structure of the locking device embedded in the element guide is somewhat different from that illustrated in FIG. 6. The structure of the locking device in this case as disassembled is illustrated in FIG. 8, which shows that the locking device is composed of a pair of cranks 51, 51 and a sliding body 52 with a key pin 56 and springs 61. Each of the cranks 51, 51 has an eccentric crank pin 54 but no supporting pivot as in FIG. 6. Instead, each of the crank pins 54, 54 is cut in a semicircular cross section at the end thereof to form a plane surface facing that of the other crank pin 54 so that the crank pins 54, 54 are engaged with each other in the oblong opening 57 of the sliding member 52 to form a complete circular cross section whereby both cranks 51, 51 are united integrally when the locking device is assembled permitting their simultaneous rotation when either one of the cranks 51, 52 is rotated by turning the key inserted to the key hole 49 of the crank 51 through the key guide 50.

As is understood from the above description, it is essential in the lock slider in accordance with the invention that the support member of the pull tab extends over the substantially whole length of the slider body and the key guide leading to the key hole has its opening on the head of one of the upright leg portions so that the sliding movement of the slider by the pull tab is not resisted regardless of the direction of sliding as in the conventional sliders and the insertion of a key into the key guide is never hindered by the pull tab regardless of its position.

What is claimed is:

1. A slider with a built-in locking device in a slide fastener which comprises:

(a) a slider body with the locking device built within an element guide thereof and provided with a key hole opening in the front half of the upper surface thereof, (b) a support member for a pull tab in a form of a shackle extending substantially over whole length of the slider body comprised of two upright leg portions positioned adjacent the rear and the front ends respectively of the upper surface of the slider body and an arm spanned between the two upright leg portions, at least one of the upright leg portions being integrally fixed to the slider body and the upright leg portion positioned in the front end of the slider body being provided with a key guide leading to the key hole, and (c) a pull tab having a ring end portion in engagement with the support member.

2. The slider with a built-in locking device as claimed in claim 1 wherein the support member permits engagement thereby with the pull tab ring end portion for forwardmost extension of the pull tab such that passage of a key into the key hole is not blocked.

* * * * *